US010131526B2

(12) United States Patent
Clusserath

(10) Patent No.: US 10,131,526 B2
(45) Date of Patent: Nov. 20, 2018

(54) SYSTEM AND METHOD FOR FILLING CONTAINERS

(71) Applicant: KHS GmbH, Dortmund (DE)

(72) Inventor: Ludwig Clusserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 563 days.

(21) Appl. No.: 14/372,565

(22) PCT Filed: Dec. 24, 2012

(86) PCT No.: PCT/EP2012/005377

§ 371 (c)(1),
(2) Date: Jul. 16, 2014

(87) PCT Pub. No.: WO2013/107493

PCT Pub. Date: Jul. 25, 2013

(65) Prior Publication Data

US 2014/0360621 A1 Dec. 11, 2014

(30) Foreign Application Priority Data

Jan. 18, 2012 (DE) ..... 10 2012 000 758

(51) Int. Cl.
*B67C 3/02* (2006.01)
*B67C 3/20* (2006.01)
*B65B 3/28* (2006.01)

(52) U.S. Cl.
CPC ..... *B67C 3/023* (2013.01); *B65B 3/28* (2013.01); *B67C 3/202* (2013.01)

(58) Field of Classification Search
CPC ..... B67C 3/202; B67C 3/023; B65B 3/28; B65B 1/32
USPC ..... 141/83, 144–152, 9, 103
See application file for complete search history.

(56) References Cited

U.S. PATENT DOCUMENTS 4,230,195 A 10/1980 Graffin
6,073,667 A * 6/2000 Graffin ..... B67C 3/202 141/372
6,772,806 B2 * 8/2004 De Villele ..... B65B 43/60 141/103

(Continued)

FOREIGN PATENT DOCUMENTS

DE 4002395 A1 1/1990
DE 10301844 A1 5/2004

(Continued)

*Primary Examiner* — Timothy L Maust
*Assistant Examiner* — Timothy P Kelly
(74) *Attorney, Agent, or Firm* — Occhiuti & Rohlicek LLP

(57) ABSTRACT

An apparatus for filling containers with a liquid filling material includes a container treatment unit, a weighing unit, container carriers, weighing cells, a conveying element, filling positions, container receptacles, and a container-conveying section. As the conveying element, on which the filling positions are formed, rotates, it introduces filling material into the containers. The conveying element includes the container-conveying section, which moves the containers in a container-conveying direction. The weighing unit, which is made in the conveying element, weighs containers on the container-conveying section. Each container receptacle forms a weighing position with an associated container carrier and weighing cell.

14 Claims, 4 Drawing Sheets

(56) References Cited

U.S. PATENT DOCUMENTS

| | | | | |
|---|---|---|---|---|
| 9,302,894 | B2 * | 4/2016 | Poeschl | B67C 3/02 |
| 2003/0145901 | A1 * | 8/2003 | Noell | B65B 3/04 141/2 |

FOREIGN PATENT DOCUMENTS

| | | | |
|---|---|---|---|
| DE | 102010032398 | A1 | 2/2012 |
| EP | 0636574 | A1 | 1/1995 |
| EP | 0659683 | A1 | 9/2002 |
| EP | 1025424 | B1 | 9/2002 |

* cited by examiner

SYSTEM AND METHOD FOR FILLING CONTAINERS

RELATED APPLICATIONS

This application is the national stage under § 371 of PCT/EP2012/005377, filed on Dec. 24, 2012, which claims the benefit of the Jan. 18, 2012 priority date of German application 10 2012 000 758.2. The contents of all the foregoing applications are incorporated herein by reference.

FIELD OF INVENTION

The invention concerns filling containers, and in particular, filling containers with a liquid filling material.

BACKGROUND

Devices or systems for a quantity-controlled, and thus also volume-controlled filling of containers with a liquid filling material are known. In a known device, the filling positions provided on the circumference of a rotor that can be driven to rotate around a vertical machine axis consist in each case of a filling element and a container carrier. During the filling or the filling process, the container carrier suspends the containers, which can be bottles, by a neck or throat ring formed on their respective bottle necks. A weighing cell connects the container carrier to the rotor.

During filling, the weight of the particular container is recorded. This permits the quantity of filling material introduced into the container to be controlled.

In a high output device, which fills a large number of bottles per unit time, there is not much time between when the bottles are filled and when they are passed to a subsequent conveying station. As a result, there is very little time to weigh the filling material. This can be a disadvantage.

Also known is a filling machine for filling containers with a rotor that can be rotated around a vertical machine axis and with a plurality of filling positions provided on the rotor.

On a transport star, which forms either a container inlet or a container outlet, there is provide a manipulator with a weighing installation. These are used to remove randomly selected containers from the container flow, to weigh these containers, and to then re-insert them into the container flow. Removing containers from the container flow, weighing them, and returning the containers into the container flow takes a considerable time. As a result, it is difficult to achieve high output. Moreover, the processes of removing containers from the container flow and reinserting them can be failure-prone.

Also known is a device for the automatic quality control of test pieces, in particular of tablets or pills. Such a device includes a rotating transport wheel driven forming a plurality of receptacles on its circumference. This wheel moves test pieces past a weighing station to weigh them. However, this known device is not suitable for a quantity-controlled or volume-controlled filling of containers.

SUMMARY

The invention features an apparatus with which, while avoiding the drawbacks of the prior art, a quantity-controlled or volume-controlled filling of containers with a high level of precision is possible.

The apparatus according to the invention is suitable for the filling of containers, in particular bottles with a neck or throat ring, with a filling material that consists of either a single component or a plurality of components that are introduced simultaneously into the container.

The apparatus according to the invention is suitable in particular for quantity-controlled or volume-controlled filling of containers with a filling material or with filling material components that have enough solid content to render conventional flow meters, in particular magnetically inductive flow meters, somewhat useless as a result of inadequate measuring precision.

The apparatus according to the invention is especially suitable as a dosing filling system in which at least two components of the filling material are introduced into the particular container one after the other. In such a case, a first component has an increased solid content and comprises, for example, fruit flesh or fruit fibers, and a second component is either free of solids or contains only a reduced proportion of solids.

Regardless of this, the filling of the containers with the system according to the invention takes place preferably in at least two steps, i.e. each container is initially partially filled in a first step or in a first filling phase in a container treatment unit designed as a filling machine or filling unit, and subsequent to that, outside this filling unit, the weight of each partially filled container is determined in a weighing unit or in a container conveying element made as a weighing unit, preferably a transport star, wherein the containers are moved continuously on the container conveying section of the system, i.e. without removing the container from the container flow or the conveying section. In an adjacent step or in a subsequent container treatment unit in the container conveying direction and in the form of a filling unit, a further filling then occurs, for example a final filling or residual filling of each container, so that it then has a specified target filling weight or a set target filling material quantity. The container conveying direction is moreover the conveying direction in which the containers are moved through the system.

In a further development of the invention, further conveying elements or transport stars provided in the conveying section of the containers can also be embodied as weighing units, i.e. be fitted with container receptacles forming weighing positions, each of which has a container carrier, preferably for the suspended attachment of the containers and an associated weighing cell to determine the container weight. The measured results established in the measurement of the container weight are then used preferably for the control or adjustment of container treatment units or filling units or for the control or adjustment of the filling positions or filling elements there, which are in the container conveying direction before the particular weighing unit or after the particular weighing unit, this being for the control or adjustment of the treatment or filling process of the container which was weighed in the weighing unit or on a weighing position there. Furthermore, the measured results established from the weighing are used for example for the control or adjustment of the treatment or filling process of a container other than the weighed container, for example for the correction of a filling unit before the weighing unit relative to the container conveying direction, or for the correction of the filling material quantity dispensed by the filling elements there, for example by the corresponding extension or shortening of the filling or opening time of the relevant filling element and/or by changing a reference or target value used in the control of the filling process.

As during the entire process, the position of each container can be tracked precisely inside the system, it is in particular also possible to individually control the filling positions or filling elements of the filling unit before or after the weighing unit relative to the container conveying direction, depending on the container weight established, i.e. to correct the dispensed filling material quantity of the particular filling position, at which the weighed container was at least partially filled, and/or to adjust or control the filling position of a subsequent filling unit, at which the relevant container is further or residually filled, by changing the dispensed filling material quantity or a reference value determining this filling material quantity such that the particular container is finally filled with a specified filling material quantity.

The system according to the invention is for example part of a complete system which contains further components or units, such as an empties unpacker, rinser, stretch blow-molding machine to make containers from preforms by stretch blow-molding, inlet or infeed worm, closing and labeling machine etc., dosing filler, main filler.

As used herein, "containers" include cans, bottles, tubes, pouches, in each case made of metal, glass, and/or plastic, as well as other packaging means which are suitable for filling with liquid or viscous products.

As used herein, "quantity-controlled filling" or "volume-controlled filling" in the meaning of the invention means in particular also a filling of containers whereby the quantity of filling material introduced into the containers is recorded by weight measurement or by determining the container weight.

As used herein, "free-jet filling" means a process in which the liquid filling material flows into the container to be filled in a free filling jet, wherein the container does not lie with its mouth or opening against the filling element, but is at a distance from the filling element or from a filling material outlet there.

In one aspect, the invention features an apparatus for filling containers with a liquid filling material. Such an apparatus includes a first container treatment unit, a weighing unit, container carriers, weighing cells, a conveying element, filling positions, container receptacles, and a container-conveying section, wherein the filling positions are formed on the conveying element. The conveying element, which is driven to rotate for controlled introduction of filling material into the containers, includes the container receptacles. The container-conveying section moves the containers in a container-conveying direction through the apparatus. The weighing unit is configured to measure a weight of a container on the container-conveying section. Each of the container receptacles forms a weighing position with an associated one of the container carriers and an associated one of the weighing cells. The container treatment unit is selected from the group consisting of a filling machine and a filling unit.

In some embodiments, the conveying element that forms the weighing unit comprises a transport star.

Other embodiments include a second container treatment unit, with the first and second container treatment units being provided one after the other, at least one of which includes a filling unit. A container conveying section between the first and second container treatment units includes a structure that is either a container conveying element made as a weighing unit or a weighing unit formed by the a container conveying element. In some of these embodiments, the structure is provided before the filling unit relative to the container conveying direction, while in others, the structure is provided after the filling unit relative to the container conveying direction.

In some embodiments, the container carriers are configured to suspend the containers.

In other embodiments, the first container treatment unit comprises at least one of the container carriers, and the at least one of the container carriers is configured to suspend a container.

Other embodiments further include a process computer configured to control a filling element in response to a weight of a container provided to the filling element. Among these are embodiments in which the process computer is configured to cause the filling element to correct a filling material quantity introduced into the particular container.

Yet other embodiments include process computer, the process computer being configured for controlling filling of a container by a filling unit based on a weight of the container that has been measured by the weighing unit and provided to the process computer as measured. The process computer is configured to determine a difference between a target and a measurement, the target being either a target filling material quantity or a target filling material volume. The measurement is a measured weight of the container or a filling volume established for the container. The process computer is further programmed to cause introduction of filling material into the container in an amount selected based on the difference.

Also included are embodiments that have both a process computer and a second container treatment unit. The second container unit follows the first container treatment unit in the container-conveying direction. The first container treatment unit is configured to introduce a first component of the liquid filling material into the container, and the second container treatment unit is configured to introduce a second component of the liquid filling material into the container. The process computer controls amounts of the first component and second components to be introduced into the container based on a weight of the container as measured by the weighing unit.

In another aspect, the invention features a method for filling containers with a liquid filling material. Such a method includes using an apparatus that comprises a container treatment unit that comprises a filling unit with filling positions provided on a rotating conveying element, and a container-conveying section that conveys containers in a conveying direction, weighing the container while the container is moved by the container-conveying section, and, after having weighed the container, recording the weight.

In some practices, recording the weight includes recording the weight while the container is at a weighing position that has a weighing cell, the weighing cell being one of a plurality of weighing cells that provided on a circumference of the rotating conveying element.

Yet other practices include using the weight as a basis for at least one of controlling and adjusting container-treatment units.

Some practices further include, using the weight, either controlling or adjusting either treatment or filling of subsequent containers. Among these practices are those that further include controlling or adjusting filling positions or filling elements of a preceding filling unit in the container conveying direction, and practices that include controlling or adjusting filling positions or filling elements of a following filling unit in the container conveying direction. Also among these practices are those in which control or adjustment of the filling elements takes place individually, in which case the method further includes correcting a fill quantity dispensed by the filling element depending on a weight determined for a container, and those in which control or adjustment of the filling elements takes place individually, wherein depending on a measured weight of a container, a filling material quantity that is introduced into the container by a filling element of a following filling unit is set or adjusted so that the container has the desired target filling material quantity after filling thereof.

Some practices include using the weight as a basis for either controlling or adjusting a container treatment process carried out on a different container.

Other practices include causing the container to be suspended by at least one of a neck and a throat ring while weighing the container.

Yet other practices include causing the container to stand on a base thereof while weighing the container.

As used herein, "container conveying elements" are conveyors or conveying elements of the system, by means of which a container flow is routed during the operation of the system. In the meaning of the invention, "container conveying elements" are in particular transfer or transport stars.

As used herein, the expression "substantially" or "approximately" means deviations from exact values in each case by +/−10%, and preferably by +/−5% and/or deviations in the form of changes not significant for functioning.

Further developments, benefits and application possibilities of the invention arise also from the following description of examples of embodiments and from the figures.

In this regard, all characteristics described and/or illustrated individually or in any combination are categorically the subject of the invention, regardless of their inclusion in the claims or reference to them. The content of the claims is also an integral part of the description.

BRIEF DESCRIPTION OF THE DRAWINGS

These and other features and advantages of the invention will be apparent from the following detailed description and the accompanying figures, in which.

DETAILED DESCRIPTION

Figure 1:
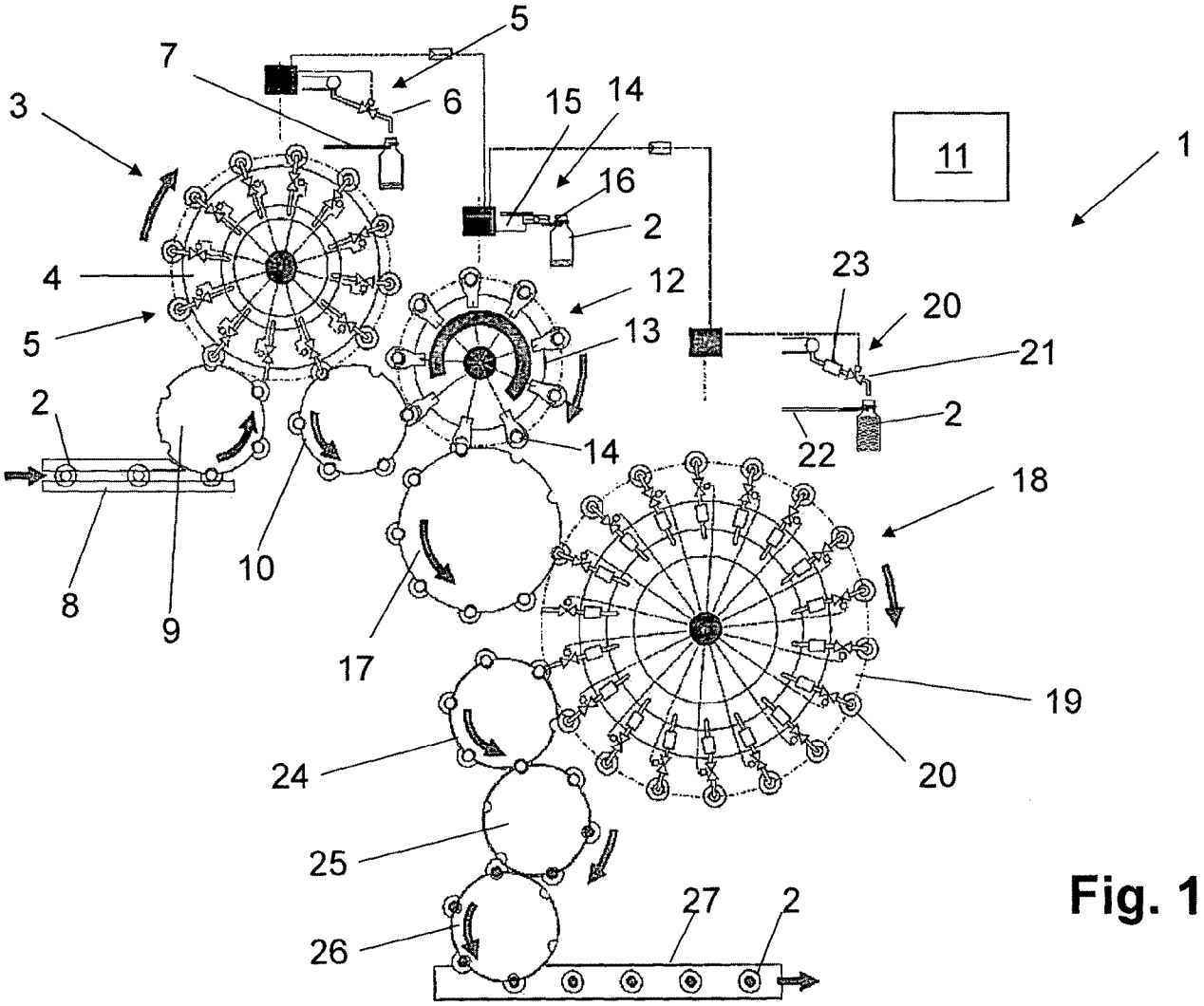
FIG. 1 is a simplified schematic top view of an apparatus for filling containers with a filling material.
Figure 2:
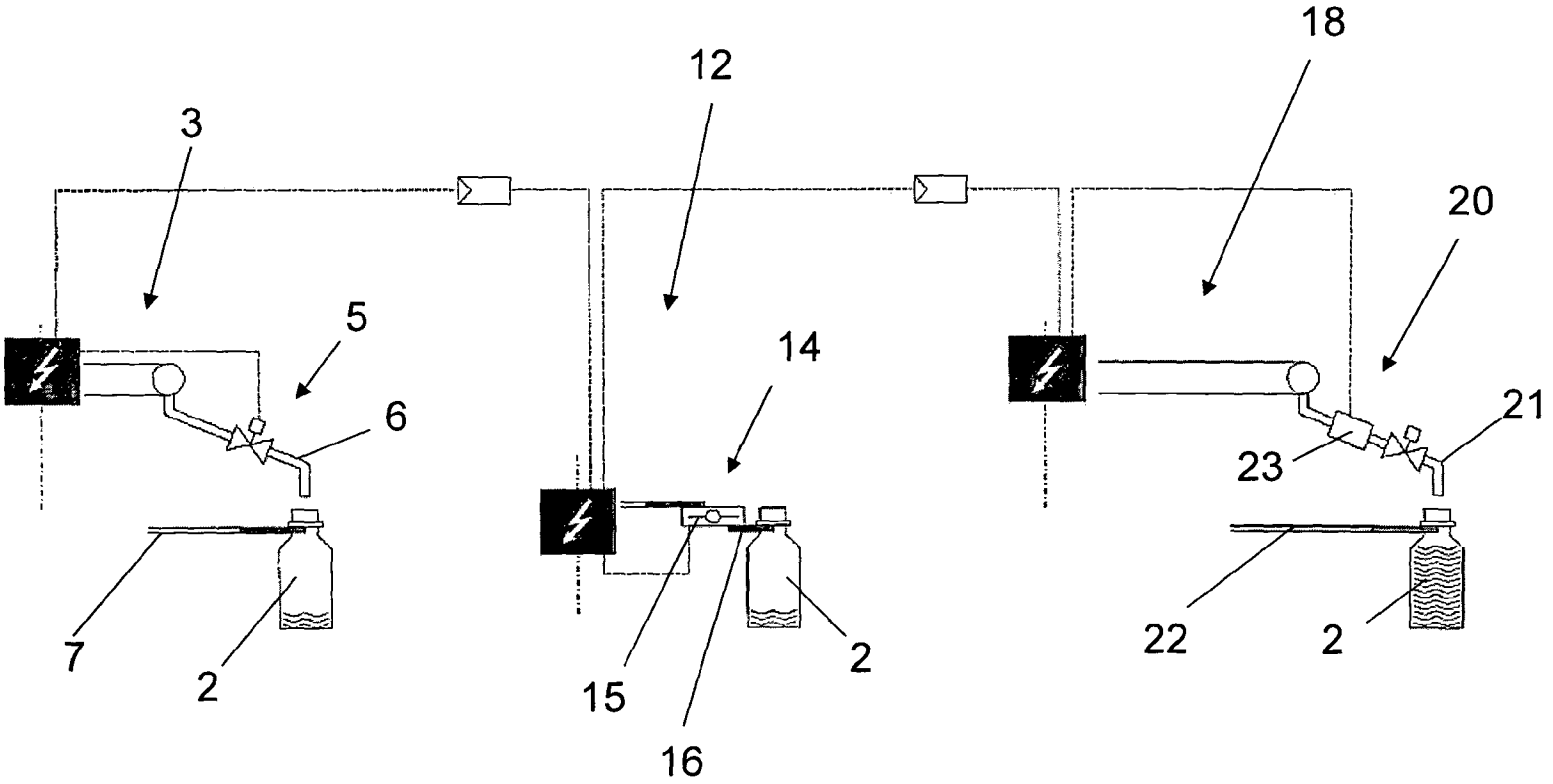
FIG. 2 is a schematic representation to explain the method carried out with the apparatus in FIG. 1.

The apparatus 1 in FIG. 1 serves for volume-controlled and/or quantity-controlled filling of containers with a liquid filling material. In the illustrated embodiment, the containers are bottles 2.

The filling material includes a first component K1 and a second component K2. The first component K1 has an increased content of solids. The second component K2, which is introduced chronologically after the first component, contains either no solid contents or practically no solid contents. In the case of a filling material in the form of fruit juice, the solids are would include fruit flesh, fruit fibers, etc.

The apparatus 1 includes a first container treatment unit, such as a first filling machine or a first filling unit 3 with a first rotor 4 that can be driven to rotate around a first vertical machine axis. On the circumference of the first rotor 4 are filling positions 5. The filling positions 5 are distributed at regular angular distances and at the same radial distance from the first machine axis A. Each filling position 5 includes a filling element 6 and a container carrier 7 from which the bottles 2 are suspended, by their neck or throat ring, during the filling procedure. In the illustrated embodiment, the filling procedure is a free-jet filling procedure.

A first external conveyor 8 supplies empty bottles 2 standing upright i.e. with their bottle axis oriented in a vertical direction. A first transport star 9 transfers the containers from the first conveyor 8 to a filling position 5. This first transport star 9 forms a container inlet.

The filling of the bottle 2 with the first component K1 takes place within an angular range of the rotary movement of the rotor 4 between the container inlet, which is formed by the first transport star 9, and a container outlet, which is formed by a second transport star 10. This filling is either time-controlled or quantity-controlled. In time-controlled filling, a control computer 11 opens a filling element 6 and closes it after lapse of a filling time. In quantity-controlled filling, the control computer 11 closes a filling element based on a measuring signal provided by a flow meter allocated to the filling position 5.

The second transport-star 10 moves bottles 2 filled with the first component K1 to a weighing unit 12. The weighing unit 12 includes a third transport-star 13 that rotates around a vertical axis of rotation. Weighing positions 14 are provided on a periphery of the third transport-star 13. These weighing positions 14 are offset at regular angular distances around the axis of rotation and at the same radial distance from the axis of rotation. Each weighing position 14 includes a weighing cell 15 and a container carrier 16.

The second transport-star 10 moves the partially filled bottles 2 onto a weighing position 14. At the weighing position 14, the container carrier 16 suspends the bottle 2 by its neck ring. As the third transport-star 13 rotates, the weighing cell 15 measures the gross weight of the bottle 2.

The process computer 11 processes the result of this weight measurement. In particular, the process computer 11 assumes that the empty bottles 2 all have the same or substantially the same empty weights. As a result, the process computer 11 determines the quantity of filling material actually introduced into the particular bottle 2. Alternatively, or in addition, the process computer 11 determines the corresponding filling material volume of the first component K1 and the amount of volume of the second component K2 that is necessary to achieve the total target filling material quantity or the necessary total target filling material volume.

The weighing of bottles 2 that have been partially filled with the first component K1 takes place on an angular range of the rotary movement of the third transport-star 13 that is between the container inlet of the weighing unit 12, which is formed by the second transport star 10, and the container outlet formed by a fourth transport-star 17.

In the illustrated embodiment, the fourth transport-star 17 forms the container inlet of a second container treatment unit in the form of a filling machine or second filling unit 18. The second filling unit 18 has a second rotor 19 driven to rotate about a second vertical machine axis. Filling positions 20 are disposed along the circumference of the second rotor 19 at regular angular distances around the second vertical machine axis and at the same radial distance from this second vertical machine axis. These filling positions 20 introduce the second component K2 of the liquid filling material into the bottles 2.

Each filling position 20 includes, once again, a filling element 21 and a container carrier 22. The container carrier 22 suspends the bottles 2 by their respective necks or throat rings, this being for free-jet filling.

The filling elements 21 are controlled or adjusted in the way described in more detail below, in particular also depending on the weight of the bottle 2 measured in each case on the weighing unit 12.

The introduction of the second component K2 in the bottles 2 takes place under quantity-control or volume-control. Quantity-control involves opening and closing the particular filling element 21 depending on the measuring result of the weight measurement or depending on a measuring signal of a flow meter 23 individually allocated to each filling element 21. Time control involves opening the filling element 21 during an opening time that is set, for example, in the process computer 11 for each filling position 20 depending on the weight of the bottle 2 concerned, as established in the weighing unit 12.

The filling of the bottles 2 with the second component K2 takes place within an angular range of rotary movement of the second rotor 19 that is between the container inlet, which is at the fourth transport-star 17, and the container outlet of the second filling unit 18, which is formed by a fifth transport-star 24. The fifth transport-star 24 then supplies these bottles 2, which have been thus filled with both the first component K1 and the second component K2, to a closing machine or to a closing unit 25 of a rotary design. The closing unit 25 closes the containers in an appropriate manner. The filled and closed bottles 2 are then moved on by a sixth transport star 26 to an external conveyor 27.

It is clear that all of the transport stars 9, 10, 13, 17, 24, 26, the first and second rotors 4, 19, and the closing unit 25 are driven synchronously and in opposite directions so that these apparatus components form a container conveying section for the bottles 2 through the apparatus. This container-conveying section moves bottles 2 continuously from the first external conveyor 8 onto the last external conveyor 27. By taking into account, for example, the angular position of the first and/or second rotors 4, 19, the process computer 11 also knows unambiguously at which position in particular in the weighing unit 12 and in the first and second filling units 3, 18, a particular bottle is located.

With the apparatus 1, different modes of operation are possible.

In the simplest case, the weight of each bottle 2 arranged at the weighing position 14 is determined. Then, taking into account the fact that all empty bottles weigh the same amount, a quantity or volume of the first component K1 is determined and introduced into the bottle 2.

With this data, the filling of the same bottle 2 with the second component K2 after its transfer to the second filling unit 18 is then controlled at the relevant filling position 20. This can include, for example, taking into account the measuring signal supplied by the associated flow meter 23, which can be a magnetically inductive flow meter, or by controlling a time during which the filling element 21 is open based on the weight measured so that, in the end, each filled bottle 2 has the necessary quantity of filling material or the necessary volume of filling material.

As previously mentioned, the introduction of the first component K1 into the bottles 2 at each filling position 5 of the first filling unit 3 takes place in a manner that is controlled by time or by quantity according to control values stored in the process computer 11.

Instead of the procedure described above or however in addition to it, the apparatus 1 also allows a method that relies on recorded weights of each bottle 2 that has been partially filled with the first component K1. These weights were recorded by the weighing unit 12 or by its associated weighing positions 14.

Based on these recorded weights, a correction of the control of the filling elements 6, for example of the time control of the filling elements 6, takes place. Following this correction, the weight measured in the weighing unit 12 of subsequent bottles 2 that have been partially filled with the first component K1 corresponds exactly to a specified target weight.

This correction method is preferably designed so that, for each filling position 5 or for each filling element 6, the correction occurs individually, in a way that depends on the weight established in the weighing unit 12 or at the corresponding weighing position 14 for the bottle 2 that has been partially filled with the component K1 at the particular filling position 5. As a result, the filled bottles 2 at the outlet of the second filling unit 18, not only have the necessary quantity of filling material, but also the components K1 and K2 in the required mix ratio.

Instead of time control or quantity control with a flow meter, a fill-level control with sensors is also possible at the filling positions 5.

Above, it was assumed that the apparatus 1 is used for filling bottles 2 with a filling material that has the components K1 and K2 introduced into the bottles 2 chronologically one after the other. Naturally, the apparatus 1 is also suitable for the quantity-controlled or volume-controlled filling of bottles 2 with a filling material that consists only of a single component or of a plurality of components that are introduced into the container simultaneously or in a chronologically overlapping manner.

With this method too, the bottles 2 are partially filled with the first filling unit 3. The weight of the particular bottle is then measured in the weighing unit 12. On the basis of the measured values of the weight measurement, the residual filling of each bottle 2 in the second filling unit 18 to the desired target filling material quantity then takes place controlled by the process computer 11. Taking account of the weight of each partially filled bottle 2 measured in the weighing unit 12, a correction can once again be made to the control of the filling elements 6 of the first filling unit 3, this being preferably individually for each filling position 5 or for each filling element 6, i.e. depending on the weight of the partially filled bottle 2 at the relevant filling position 5.

Figure 3:
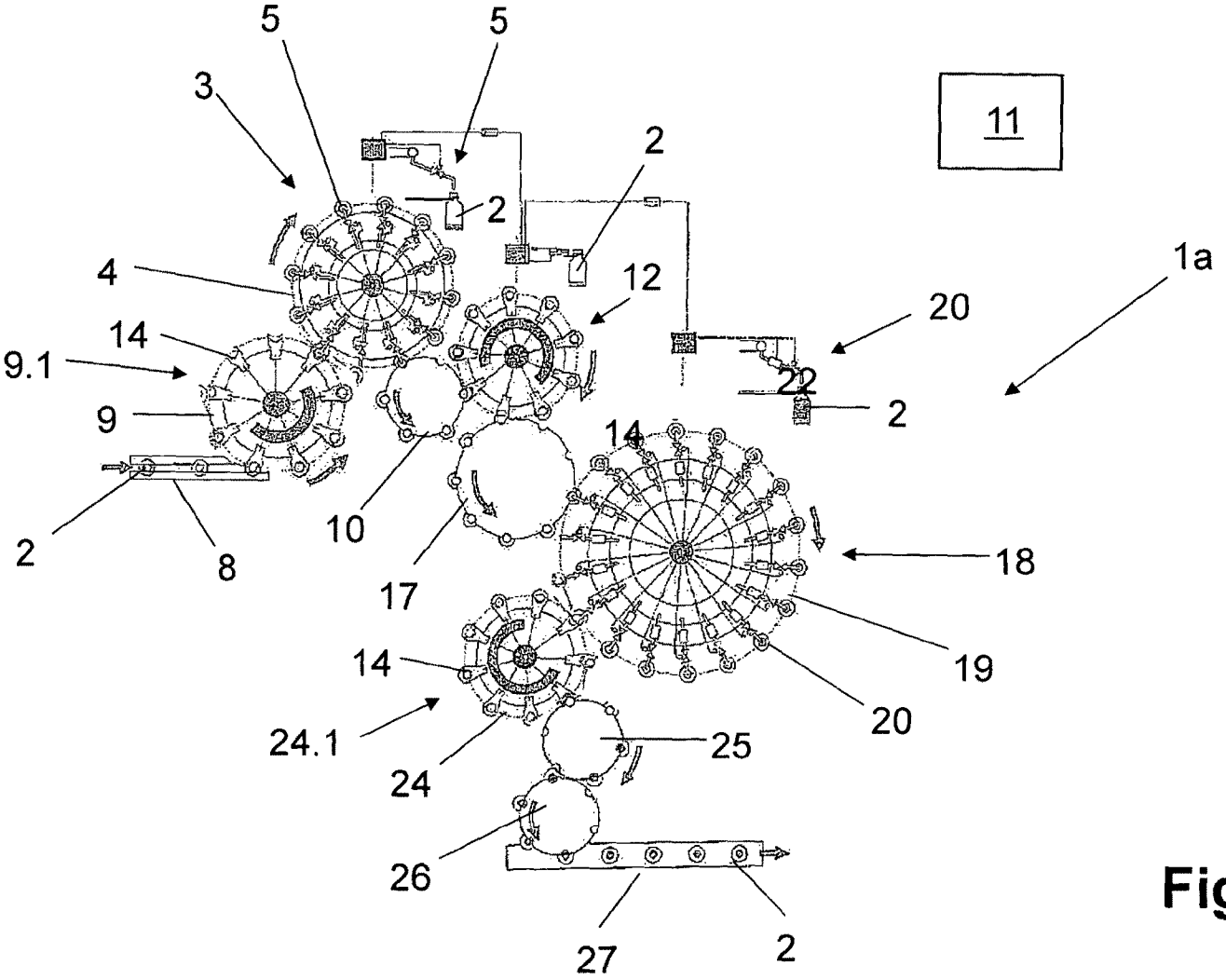
FIGS. 3 and 4 illustrate further embodiments of the invention.

Above it was assumed that only the third transport-star 13 is designed as a weighing unit 12. It is of course possible to design other or more transport stars, in particular also the fifth transport-star 24 as a weighing unit 24.1, with weighing positions 14 having, in each case, one weighing cell 15 and one container carrier 16, as illustrated in the apparatus 1*a* shown in FIG. 3. With the weighing unit 24.1 downstream of the second filling unit 18 in the conveying direction of the bottles 2, then for example, on the basis of the measured weight of each filled bottle 2, a correction of the control of the filling elements 21 and/or 6 of the upstream filling units 18, 3 in the conveying direction of the bottles 2 takes place.

If the empty weight of the bottles 2 needs to be recorded, then relative to the conveying direction of the bottles 2, a conveying element before the first filling unit 3, for example the transport star 9 is made as a weighing unit. The transport star 9 weighing positions 14 distributed at regular angular distances, each having one weighing cell and one container carrier, as likewise illustrated for the apparatus 1*a* shown in FIG. 3.

Figure 4:
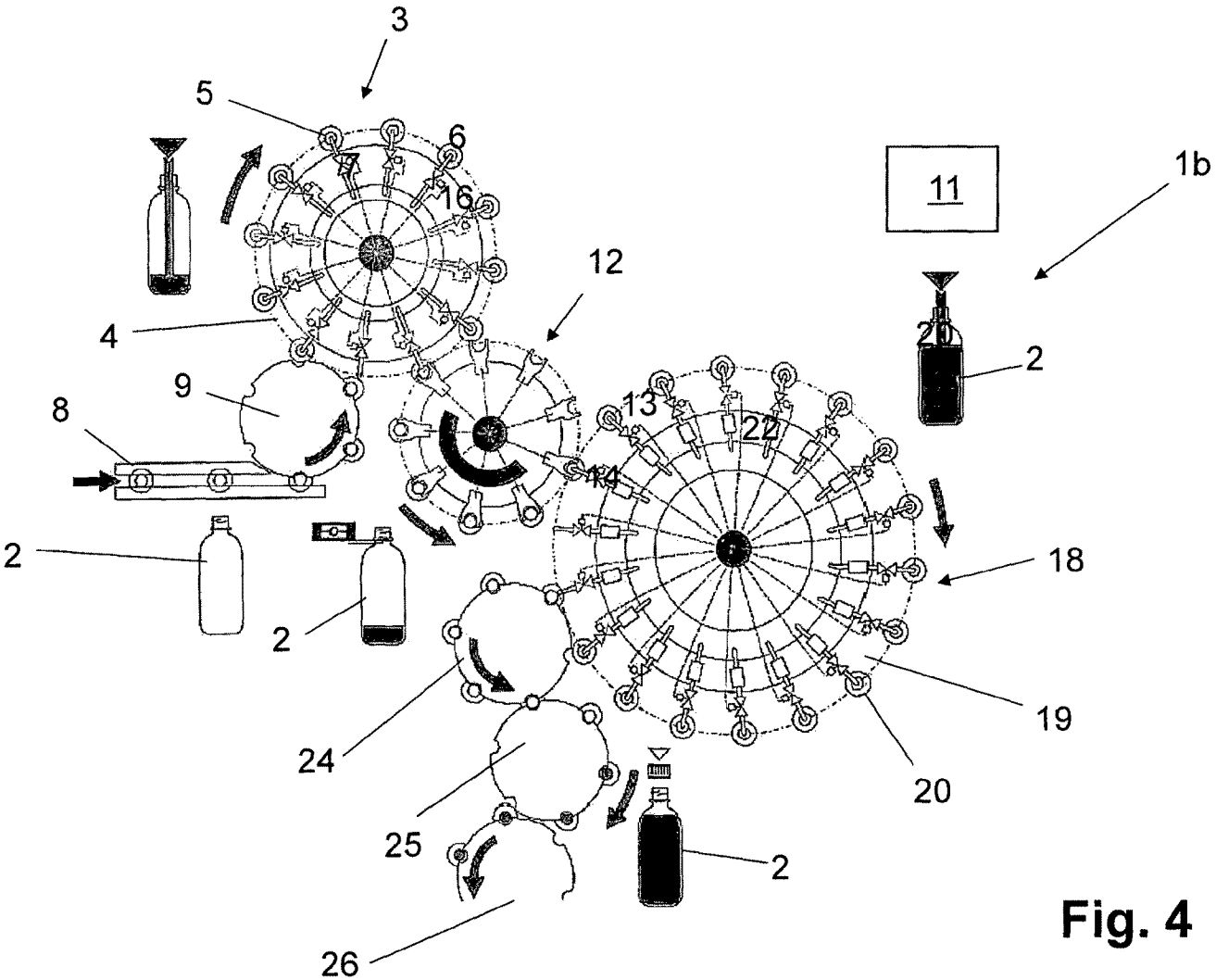

FIG. 4 shows an apparatus 1*b* that differs from the first apparatus 1 solely in that the transport stars 10 and 17 are omitted and the partially filled bottles 2 are taken from the first filling unit 3 via the third transport-star 13 or via the weighing unit 12 formed by the third transport star 13 to the second filling unit 18. The other structure and the other method of operation of the apparatus 1*a* are as those of apparatus 1.

Common to all embodiments is that, with the help of the weighing positions 14 or weighing cells 15, the weight of the particular bottle 2 is measured outside the first and second filling units 3, 18 and thus only after the end of the particular filling process, which is either the partial filling of the bottles 2 with the first filling unit 3 or the residual filling of the bottles 2 with the second filling unit 18. The weighing therefore no longer takes place during the filling process or inside the first and second filling units 3, 18. The weight measurement takes place in each case at a container-conveying element by means of which the container flow and, in apparatuses 1, 1*a* and 1*b*, the entire container flow is routed, i.e. the weight measurement takes place in the container flow and during the movement of the relevant container or the relevant bottle in the container flow, i.e. also without removing the container from and returning it to the container flow.

It has been shown that, with this procedure in the filling of bottles 2 or of other containers, the target filling material quantity specified in each case or the target filling material volume specified in each case can be adhered to very accurately. In particular, it has been shown that, by moving the weight measurement to a functional element separate from the filling machine or the first or second filling unit 3, 18, namely to the weighing units 12, 9.1, 24.1, the determination of the weight can be carried out with a high level of precision, as even with a high output of the apparatus 1, 1*a*, 1*b*, there is sufficient time for the weight measurement.

The invention was described above using exemplary embodiments. It is clear that numerous modifications and variations are possible without thereby departing from the inventive idea underlying the invention.

Thus, it was assumed that the transport stars 9.1, 12 and 24.1 are made as weighing units. Also other container-conveying elements before and/or after container treatment units, and/or container-conveying elements arranged between container treatment units can be configured as weighing units with weighing positions.

It is furthermore possible to design other container-conveying elements or transport stars of apparatus 1, 1*a* or 1*b* as a weighing unit. Such a weighing unit would then have one weighing cell and one container carrier 16.

In all the preceding embodiments, containers were held at the weighing position by their neck ring. However, the present invention extends to embodiments in which the containers, i.e. for example bottles or cans, are not held by a neck ring during weighing, but instead stand upright on the container base. By this procedure, it is possible for the containers to be treated in a way that does not require the height of the container to be changed during treatment. The operation of such an embodiment would be clear enough to one of ordinary skill in the art without undue experimentation so that no illustration of such an example would be required.

Moreover, according to the invention, the weighing positions 14 are formed of one weighing cell and one bottle plate on which the containers stand upright on their bases, with the weighing cell being a part of the bottle plate. In such a case, it is particularly advantageous for all holding elements that are in a functional connection with the container during weighing to be connected directly to the bottle plate and thus also to the weighing cell. This reliably avoids any distorting influences due to the holding or fixing of the container.

The invention claimed is:

1. A method comprising filling a container with a target weight of a filling material that is made of a first component and a second component, wherein filling said container with said target weight of said filling material comprises, suspending said container, at a filling machine, causing a first filling-element of said filling machine to introduce a quantity of said first component into said container, said first filling-element being a free-jet filling unit that causes said liquid filling-material to flow into said container in a free filling jet without a mouth of said container against said free-jet filling unit, suspending said container, which now has said quantity of said first component in it, at a weighing cell on a transport star, as said transport star rotates, weighing said container and said first quantity of said first component that was added to said container by said first filling element, recording said weight, and based on a difference, causing a second filling-element of said filling machine to introduce a quantity of said second component into said container said second filling element being a free-jet filling element that causes said second free-jet filling unit to cause said second component to flow into said container in a free filling jet without a mouth of said container against said second free-jet filling unit, wherein said difference consists of a difference between said target weight and said recorded weight, and wherein said weighing cell is one of a plurality of weighing cells that are provided on a circumference of said transport star.

2. The method of claim 1, further comprising suspending said container by a neck thereof while weighing said container at said transport star.

3. The method of claim 1, further comprising selecting said first component to comprise liquid with solid contents and selecting said second component to consist of liquid.

4. The method of claim 1, wherein suspending said container comprises suspending said container by a throat ring thereof while weighing said container.

5. The method of claim 1, further comprising causing a correction of control over said second filling element based on said recorded weight.

6. The method of claim 1, further comprising causing a correction of time control over said second filling element based on said recorded weight.

7. The method of claim 1, further comprising causing a correction of control over said second filling element based on said recorded weight, said correction being different from corrections applied to other containers that are filled by said filling machine.

8. An apparatus for free-jet filling a first container with a target weight of a filling material that comprises first and second components, said apparatus comprising a first filling-machine, a first transport-star, and a process computer, wherein said first filling-machine comprises plural free-jet filling units, each of which causes causing liquid filling-material to flow into a container that does not lie with a mouth thereof against said free-jet filling unit but is at a distance from said free-jet filling unit, wherein said first filling-machine is driven to rotate during controlled introduction of a free jet of said first component into containers suspended at each of said free-jet filling units, wherein said first transport-star comprises a plurality of container carriers, each of which suspends a container, wherein said first transport-star receives from said first filling-machine, containers that have had said first component introduced therein by said first filling-machine, wherein said first transport-star comprises container-carriers that suspend corresponding containers at corresponding weighing position from a plurality of weighing positions, wherein, at each of said weighing positions, a container that contains said first component is weighed and a weight of said container and said first component is recorded as said container moves in a container-conveying direction, wherein said process computer is configured for causing a second filling-machine to introduce free jets of said second component into corresponding containers in an amount that is based solely a difference between said target weight and a weight measurement that has been provided by said weighing cell to said process computer for said container, and wherein said weight measurement is indicative of a weight of said first component that has already been introduced into said first container by the time that said process computer causes said second component to be introduced into said first container.

9. The apparatus of claim 8, further comprising holding elements, wherein said holding elements suspend said first container during weighing thereof, and wherein said holding elements all connect directly to said weighing cell.

10. The apparatus of claim 8, wherein said second filling-machine receives containers from said weighing elements after said weighing elements have weighed said containers.

11. The apparatus of claim 8, further comprising a second transport-star, wherein said second transport-star is a constituent of said weighing unit, wherein said second transport-star comprises said weighing positions, wherein said first transport-star transfers containers from said first filling-machine to said second transport-star.

12. The apparatus of claim 11, further comprising a third transport-star disposed to receive weighed containers from said second transport-star and to provide said weighed containers to a transport-star at said second filling-machine.

13. The apparatus of claim 8, wherein said process computer is configured make an assumption that consists of all empty containers having equal weights and, based on said assumption, to determine how much of said first component has been introduced into said container by said first filling-machine, wherein said process computer is further configured to, after having determined how much of said first component has been introduced into said container by said first filling-machine, determine how much of said second component must be introduced into said container by said second filling-machine to achieve said target weight.

14. The apparatus of claim 8, further comprising a closing machine that receives containers that have had said second component introduced by said second filling-machine.

* * * * *